US006437656B1

(12) United States Patent
Guynn et al.

(10) Patent No.: US 6,437,656 B1
(45) Date of Patent: Aug. 20, 2002

(54) BROADBAND HIGH DATA RATE ANALOG AND DIGITAL COMMUNICATION LINK

(75) Inventors: Preston L. Guynn, Penn Laird; Glenn F. Dorsey, Blacksburg; Lee E. Barker, Christiansburg, all of VA (US)

(73) Assignee: Electro-Tec Corp., Blacksburg, VA (US)

( * ) Notice: Subject to any disclaimer, the term of this patent is extended or adjusted under 35 U.S.C. 154(b) by 0 days.

(21) Appl. No.: 09/696,063

(22) Filed: Oct. 25, 2000

(Under 37 CFR 1.47)

Related U.S. Application Data

(60) Provisional application No. 60/161,247, filed on Oct. 25, 1999.

(51) Int. Cl.[7] ..... H01P 1/06

(52) U.S. Cl. ..... 333/24 R; 333/261

(58) Field of Search ..... 333/24 R, 32, 333/261; 340/500; 378/15

(56) References Cited

U.S. PATENT DOCUMENTS 1,601,023 A * 9/1926 Hoyt ..... 333/130
5,208,581 A * 5/1993 Collins ..... 340/671
5,594,534 A * 1/1997 Genovese ..... 399/285

* cited by examiner

*Primary Examiner*—Justin P. Bettendorf
*Assistant Examiner*—Dean Takaoka
(74) *Attorney, Agent, or Firm*—Price, Heneveld, Cooper, DeWitt & Litton

(57) ABSTRACT

A conductive slip ring system functions to transfer information electrically between a moving frame and a stationary frame. The conductive slip ring system includes a conductive transmission line and a conductive probe. The conductive transmission line is attached to the stationary frame or the moving frame. The conductive transmission line includes a first portion and a second portion. The first portion includes a first end and a second end. The first end of the first portion is coupled to a first terminator. The second end of the first portion is coupled to a signal source through a first reflection path impedance matching resistor. The second portion includes a first end and a second end. The first end of the second portion is coupled to a second terminator and the second end of the second portion is coupled to the signal source through a second reflection path impedance matching resistor. The second end of the first portion and the second end of the second portion are coupled together by a third reflection path impedance matching resistor. The conductive probe is attached to the moving frame or the stationary frame. The conductive probe contacts the conductive transmission line and provides a communication path between the stationary frame and the moving frame. The conductive probe and the conductive transmission line are on opposing frames.

23 Claims, 6 Drawing Sheets

BROADBAND HIGH DATA RATE ANALOG AND DIGITAL COMMUNICATION LINK

This application claims priority based on U.S. Provisional Patent Application Serial No. 60/161,247 entitled, "BROADBAND HIGH DATA RATE ANALOG AND DIGITAL COMMUNICATION LINK," filed Oct. 25, 1999, the disclosure of which is hereby incorporated by reference.

BACKGROUND OF THE INVENTION

The present invention is directed to transferring electronic information between two frames (or members) that move in relation to one another, and more specifically to a communication link that utilizes conductive (or contact-type) coupling between the two frames (or members).

Contact-type slip rings have been widely used to transmit electrical signals across frames that move rotationally in relation to each other. Prior art slip rings of this nature have carried signals between a stationary frame and a rotating frame by utilizing a conductive probe or probes (precious metal alloy wipers or composite brushes) on one frame. The conductive probe or probes maintain contact with precious metal plated rings on the other frame during movement. A similar scheme has been used to transfer electrical signals between two frames that move in a non-rotational manner with respect to each other.

In digital systems, data transmission rates of these prior art contacting devices have been limited by impedance mismatch at the wipers or brushes. This impedance mismatch at the contact region causes reflections of a transmitted signal. Subsequent reflections of a reflected signal distort the pulses of the transmitted signal. Distortion of the pulses can appear as jitter, duty cycle variation, dc offset, multiple threshold crossings or other undesirable effects that result in bit errors. As a result, contact-type slip rings have not been used when higher data transmission rates were required.

Slip rings have also commonly been a part of transmission lines that carry analog signals. While an impedance mismatch in the transmission path causes some reflection of any signal, the effect on higher frequency components is more significant. When an analog signal contains high frequency components, distortion of the transmitted signal due to reflections can be severe.

Higher frequency analog transmission and higher bit rate digital transmission has been achieved with fiber optic interfaces. These fiber optic interfaces have included a rotary interface. The rotary interface has included a fiber optic rotary joint that transmits the optical signal across a gap between a rotary frame and a stationary frame. Rotary interfaces that utilize capacitive coupling have also been utilized for higher frequency analog transmission and higher bit rate digital transmission.

SUMMARY OF THE INVENTION

A conductive slip ring system, according to an embodiment of the present invention, functions to transfer information electrically between a moving frame and a stationary frame. The conductive slip ring system includes a conductive transmission line and a conductive probe. The conductive transmission line is attached to the stationary frame or the moving frame. The conductive transmission line includes a first portion and a second portion. The first portion includes a first end and a second end. The first end of the first portion is coupled to a first terminator. The second end of the first portion is coupled to a signal source through a first reflection path impedance matching resistor. The second portion includes a first end and a second end. The first end of the second portion is coupled to a second terminator and the second end of the second portion is coupled to the signal source through a second reflection path impedance matching resistor. The second end of the first portion and the second end of the second portion are coupled together by a third reflection path impedance matching resistor. The conductive probe is attached to the moving frame or the stationary frame. The conductive probe contacts the conductive transmission line and provides a communication path between the stationary frame and the moving frame. The conductive probe and the conductive transmission line are on opposing frames.

These and other features, advantages and objects of the present invention will be further understood and appreciated by those skilled in the art by reference to the following specification, claims and appended drawings.

DETAILED DESCRIPTION OF PREFERRED EMBODIMENTS

An embodiment of the present invention provides for broadband communication, that includes very low and very high frequencies, that is not feasible with a capacitively coupled system. Embodiments of the present invention can present a completely passive interface between a receiver and transmitter. Systems that are completely passive are not currently feasible with an off-axis optical interface. Because of fewer or no active components, the reliability of one or more embodiments of the present invention is typically better than either optical or capacitively coupled techniques. In general, noise levels introduced by passive systems are lower than those of systems requiring active devices.

Embodiments of the present invention are directed to a communication link that can interface high bit rate data (digital) or broadband signals (analog) from optical or electrical transmission lines across a junction allowing relative motion. The communication link features contact-type coupling which allows electronic information to be transmitted between a stationary and a moving transmission line. Although the device described herein has rotational motion, one of skill in the art will appreciate that the principles described herein can be extended to interfaces involving motion in general.

Figure 1:
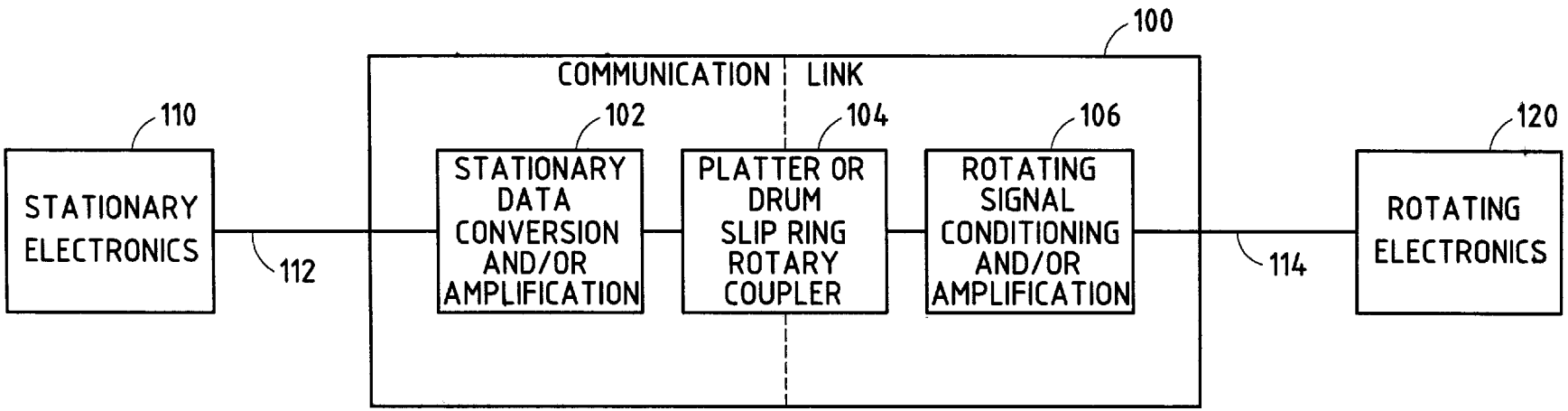
FIG. 1 is a block diagram of a communication link, according to an embodiment of the present invention.

FIG. 1 is a block diagram of a communication link 100 coupling a stationary electronic signal source 110 to a rotating receiver 120, according to an embodiment of the present invention. In FIG. 1, an electronic signal is received as an input to the communication link 100 through a transmission line 112. Transmission line 112 can be of various types (e.g., coaxial, optical, etc.). The signal (produced by source 110) can be an analog or digital signal and can be in the form of a single-ended signal on a coaxial cable, a differential signal on a balanced line or an optical signal on a fiber optic cable. In the case of an optical signal, the signal is converted to an electrical signal before injection into rotary coupler 104. This can be accomplished by using standard commercially available transceiver modules. If desired, the signal can also be amplified (by circuitry 102) before injection into rotary coupler 104. Rotary coupler 104 can be of a platter or drum-type configuration (i.e., a conductive probe (brush or wiper) meets the ring in an axial or radial orientation).

As previously discussed, rotary coupler 104 receives input from source 110 over transmission line 112 and through circuitry 102 (if present). Alternatively, the signal from source 110 can be coupled directly to conductors of the platter or drum of rotary coupler 104. After being transmitted through rotary coupler 104, the signal can be conditioned and/or amplified with circuitry 106. Alternatively, the signal can be coupled directly to receiver 120, through transmission line 114. Transmission line 114 can be of various types (e.g., coaxial, optical, etc.).

FIGS. 2A–D show four rotary coupler designs. These coupler designs are examples of rotary couplers that include a rotating transmission line with one or more conductive probes (brushes or wipers) coupled to a stationary transmission line. These implementations are included as examples and are not intended to be limiting. The stationary transmission line can be a microstrip (FIG. 2A), a coupled microstrip (FIG. 2B), a suspended microstrip (FIG. 2C), a microstrip/stripline hybrid (FIG. 2D), a coplanar waveguide (not shown) or any other transmission line configuration that allows contact between the transmission line and a conductive probe. One of skill in the art will readily appreciate that the location of the conductive probe (brush or wiper) and transmission line (fashioned as a ring) are interchangeable.

Figure 2B:
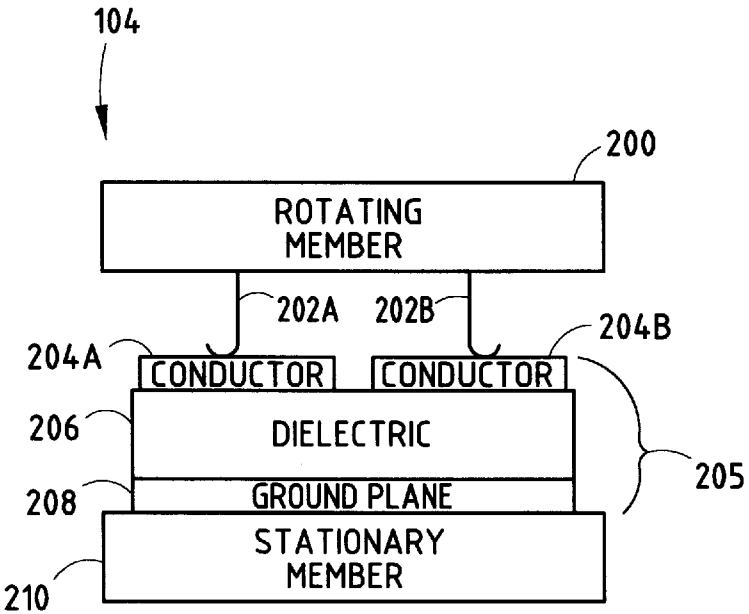
FIGS. 2A–D are cross-sectional views of four rotary coupler designs, according to embodiments of the present invention.
Figure 2A:
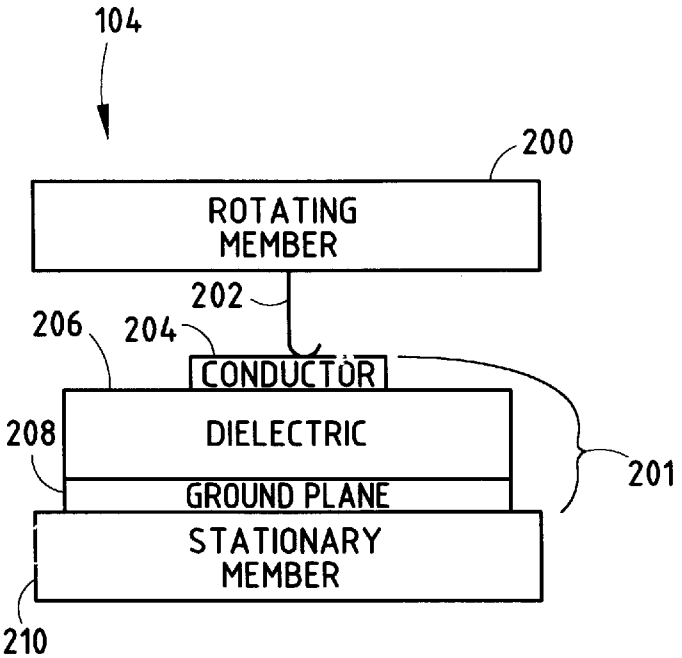

In FIG. 2A, a rotating member 200 includes a conductive probe (brush or wiper) 202 that is electrically coupled to receiver 120 (see FIG. 1). A microstrip transmission line 201 is constructed of a conductor 204, a dielectric 206 and a ground plane 208. Conductor 204 is attached to dielectric 206. Dielectric 206 is attached to ground plane 208. Ground plane 208 is attached to a stationary member 210. As rotating member 200 moves in relation to stationary member 210, probe 202 maintains electrical contact with conductor 204. Conductor 204 receives an input signal from source 110 (see FIG. 1).

FIG. 2B depicts another embodiment of rotary coupler 104. In this embodiment, rotating member 200 includes multiple conductive probes (brushes or wipers) 202A and 202B coupled to rotating member 200 and electrically coupled to multiple receivers (not shown). A coupled microstrip transmission line 205 is constructed of a pair of conductors 204A and 204B, a dielectric 206 and a ground plane 208. Conductors 204A and 204B are attached to dielectric 206. Dielectric 206 is attached to ground plane 208. Ground plane 208 is attached to stationary member 210. As rotating member 200 moves in relation to stationary member 210, probes 202A and 202B maintain electrical contact with conductors 204A and 204B, respectively. Conductors 204A and 204B receive an input signal from multiple sources (not shown).

Figure 2D:
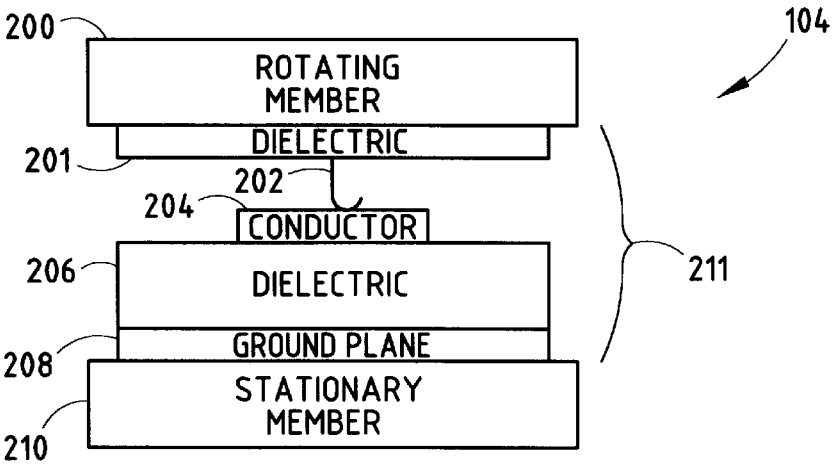
Figure 2C:
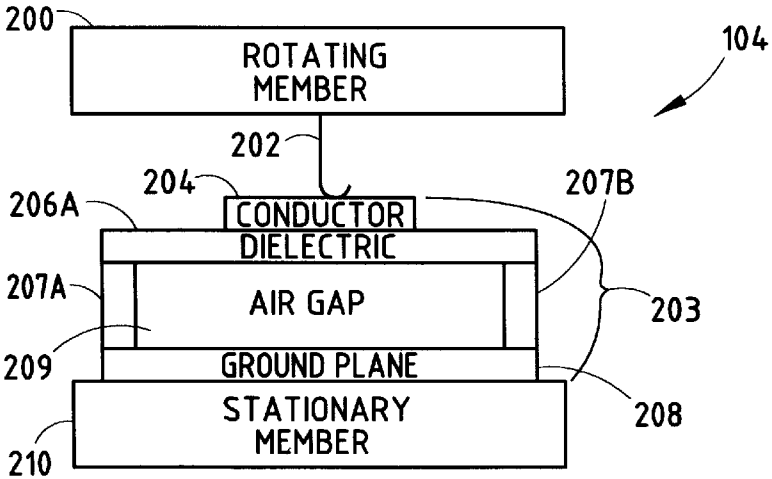

FIG. 2C depicts another embodiment of rotary coupler 104. In FIG. 2C, a rotating member 200 includes a conductive probe (brush or wiper) 202 that is electrically coupled to receiver 120 (see FIG. 1). In this embodiment, a suspended microstrip transmission line 203 is implemented. Suspended microstrip transmission line 203 includes a conductor 204, a dielectric 206A, supporting and positioning members 207A and 207B (that create an air gap 209) and a ground plane 208. Ground plane 208 is attached to a stationary member 210. As rotating member 200 moves in relation to stationary member 210, probe 202 maintains electrical contact with conductor 204. Conductor 204 receives input from source 110 (see FIG. 1).

FIG. 2D depicts another embodiment of rotary coupler 104. In this embodiment, conductive probe (brush or wiper) 202 is attached to a dielectric 201. Dielectric 201 is attached to rotating member 200. Probe 202 is electrically coupled to receiver 120 (see FIG. 1). A microstrip/stripline hybrid transmission line 211 includes a conductor 204, a dielectric 206, a dielectric 201 and ground plane 208. Conductor 204 is attached to dielectric 206. Dielectric 206 is attached to ground plane 208. Ground plane 208 is attached to a stationary member 210. As rotating member 200 moves in relation to stationary member 210, probe 202 maintains electrical contact with conductor 204. As above, conductor 204 receives input from source 110 (see FIG. 1).

Figure 3A:
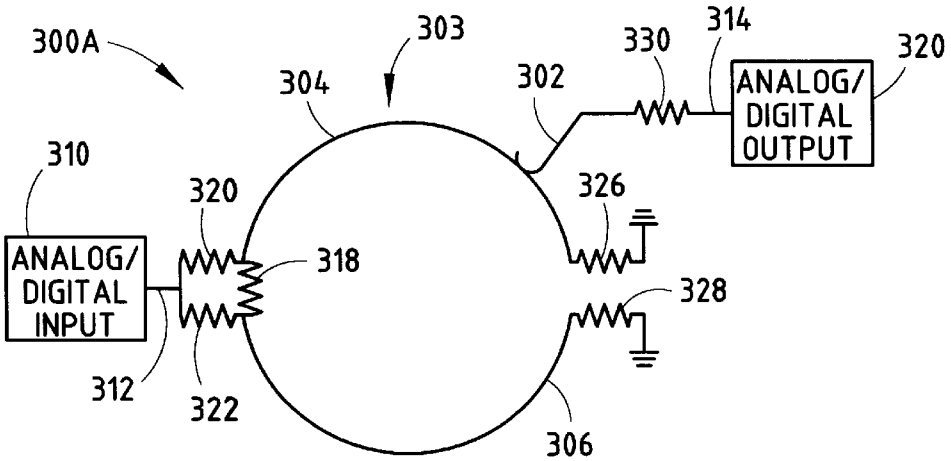
FIGS. 3A–B are electrical schematics of two 50 ohm rotary couplers, according to embodiments of the present invention.
Figure 3B:
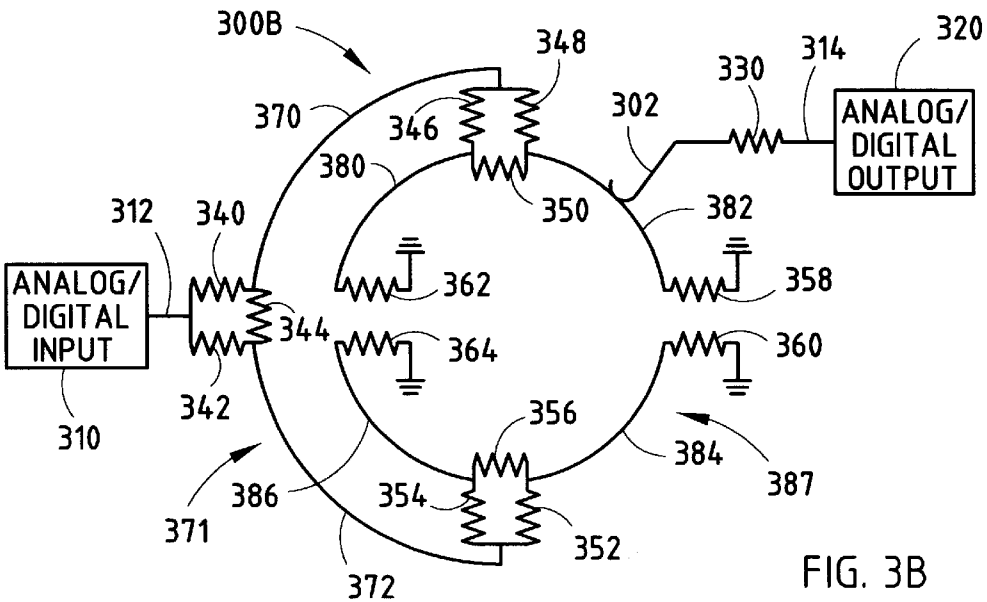

FIGS. 3A–B illustrates two designs of a 50 ohm rotary coupler system. Similar techniques can be utilized for other characteristic impedances. While part of an input signal will be reflected back toward a signal source at an impedance mismatch (caused by a conductive probe), the reflected signal will see matched impedances and will not be reflected back toward the probe. As a result, only the amplitude of the signal propagating into the probe is affected by the mismatch. Advantageously, the reflected signal is attenuated and split when propagating from the probe to the signal source (this minimizes the effect on input impedance).

In FIG. 3A, a conductive transmission line (fashioned as a ring) 303 is divided into approximately two equal lengths. Transmission line 303 includes a source gap (where a signal source 310 attaches to a first portion 304 and a second portion 306) and a termination gap (where portions 304 and 306 are terminated). Resistors at the termination gaps are selected to match the characteristic impedance of transmission line 303, thus reducing further reflections. The termination gap also prevents further transmission of any reflected signals around transmission line 303 and back to the source or probe. The source gap allows resistors to be incorporated into the signal path. This provides impedance matching for the signal reflected from the probe. The termination gap also prevents further transmission of any signal around transmission line 303 and back to the source or probe. The source gap resistor, along with the two other resistors (e.g., resistors 320 and 322), provides impedance matching for signals reflected from the probe. An external source gap resistor can alternatively be replaced with a source gap filled with a resistive material (as in thick film deposition) such that the probe contacts either the conductor or the resistive material surface.

Figure 4B:
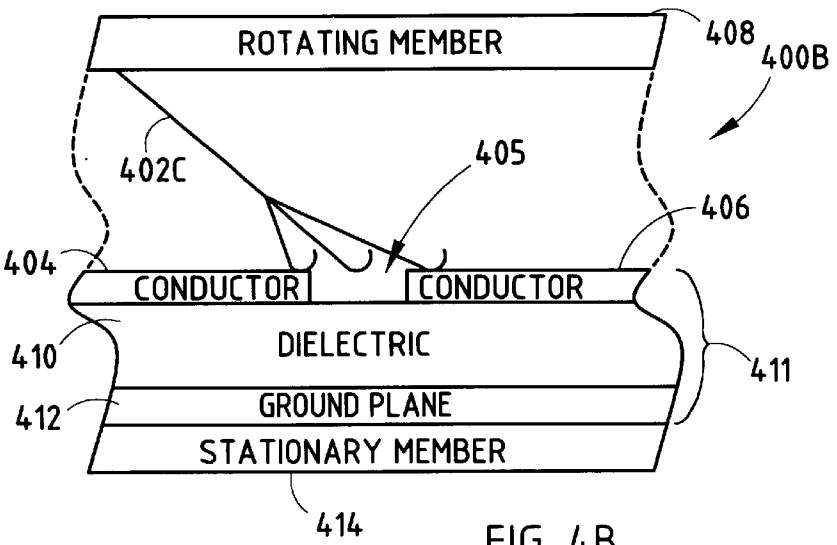
FIGS. 4A–B are views perpendicular to the transmission line and include two conductive probe designs that span a source and/or termination gap, according to embodiments of the present invention.
Figure 4A:
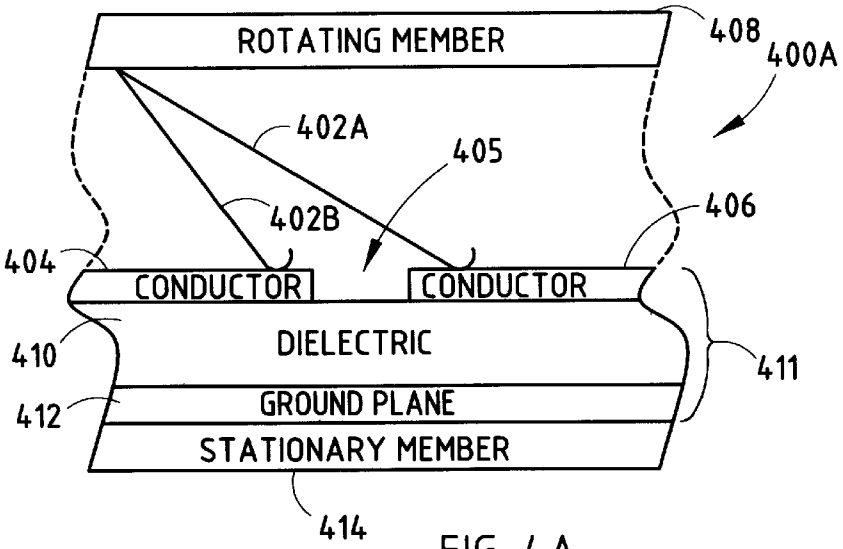

In FIGS. 4A–B, the source gap is a physical discontinuity. This source gap may require that multiple brushes be utilized to span the source gap. As discussed above, the source gap can be filled with resistive material such that there is no physical gap, obviating the need for a multiple brush configuration. This is a logical extension of the many current designs that have a physical gap in the copper; with vias connecting each portion to a resistor mounted on an opposite side of a printed wiring board.

Signal source 310 provides an analog or digital input. That input is coupled to transmission line 303 by a transmission line 312. The impedance of the transmission line 312 and transmission line 303 dictate the value of the resistors that are implemented in a given rotary coupler. As previously discussed, transmission line 303 includes first portion 304 and second portion 306. The characteristic impedance of first portion 304 and second portion 306, in the disclosed embodiment, is 50 ohms. First portion 304 is coupled to ground on a first end through a termination resistor 326. A second end of first portion 304 is coupled to source 310 through a first reflection path impedance matching resistor 320. Second portion 306 is coupled to ground on a first end through a termination resistor 328. A second end of second portion 306 is coupled to source 310 through a second reflection path impedance matching resistor 322.

The source end of portions 304 and 306 are coupled together at the source gap by a third reflection path impedance matching resistor 318. A conductive probe (brush or wiper) 302 is attached to a rotating member and maintains contact with either first portion 304 or second portion 306 of transmission line 303. A matching resistor 330 (which is used to match the impedance of probe 302) is coupled to probe 302. A transmission line 314 couples resistor 330 to a receiver 320. A digital or analog signal from source 310 propagates along transmission line 312 and sees resistor 320 in series with portion 304 in parallel with resistor 322 in series with portion 306. The signal splits with approximately one-half propagating along portion 304 and the other half along portion 306. The signal propagating along portion 306 reaches termination resistor 328 and is dissipated without reflection. The signal propagating along portion 304 reaches probe 302 which is in parallel with transmission line 304 (beyond the probe). At that point, a part of the signal continues to propagate along portion 304 (beyond the probe) and reaches terminating resistor 326 and is dissipated without reflection. Another part of the signal propagates along the probe of impedance 'X' (where, for example, $25 \leqq X \leqq 200$ ohms until it reaches resistor 330, where it sees resistance (X−50) in series with the 50 ohm transmission line 314, and continues to propagate to receiver 320, without reflection.

A different part of the signal is reflected back along portion 304 toward the source (transmitter). This signal reaches the junction where it sees resistor 320 in series with transmission line 312 and in parallel with resistor 318 in series with portion 306. Since this is not (50+50) paralleled by (50+50) (i.e., 100 ohms paralleled by 100 ohms which is 50 ohms) the reflected signal splits in half. Approximately one-half of the signal travels through resistor 320 into transmission line 312 and the other half through resistor 318 into portion 306. Each half of the reflected signal is dropped in amplitude by approximately one-half due to resistive dissipation. As a result, approximately, one-quarter of the reflected signal reaches the transmitter, and one-quarter of the reflected signal propagates along portion 306 until it reaches termination resistor 328 and is dissipated without further reflection.

As shown, resistors 320, 318 and 322 are coupled in a delta configuration, which is necessary to match the reflected signal. If the probe 302 is in contact with portion 304, then resistors 320 and 318 are needed to match the reflected signal. If the probe 302 is in contact with transmission line 306, then resistors 318 and 322 are needed to match the reflected signal. Resistors 320 and 322 are both needed to match the source. As previously mentioned, the source gap allows resistor 318 to be introduced into the transmission line that the probe is contacting. Resistor 318, which electronically connects the portions across the gap, is one of three which match impedance for the reflected signal.

FIG. 3B depicts a rotary coupler 300B, according to an embodiment of the present invention. A signal source 310 provides either an analog or digital signal across transmission line 312. Transmission line 312 is coupled to reflection path impedance matching resistors 340 and 342. A signal provided by signal source 310 is divided and coupled onto portions 370 and 372 of conductive transmission line 371. Portions 370 and 372 are coupled together by a reflection path impedance matching resistor 344 at a source gap.

A second end of portion 370 is coupled to reflection path impedance matching resistors 346 and 348, which further divide the input signal. This divided input signal is coupled to portions 380 and 382 of conductive transmission line 387 (fashioned as a ring). Portions 380 and 382 are coupled together by a reflection path impedance matching resistor 350. A second end of portion 380 is coupled to ground through a termination resistor 362. A second end of portion 382 is coupled to ground through a termination resistor 358. In a similar manner, conductive portion 372 is coupled to reflection path impedance matching resistors 354 and 352. The divided input signal is also further divided as it is coupled to portions 384 and 386 of conductive transmission line 387. A second end of portion 386 is coupled to ground through a termination resistor 364. A second end of portion 384 is coupled to ground through a termination resistor 360. A conductive probe (brush or wiper) 302 maintains contact with at least one of portions 380, 382, 384 and 386 as it moves in relation to conductive transmission line 387. Probe 302 is connected to a receiver 320 through a reflection path impedance matching resistor 330 and transmission line 314.

FIGS. 4A–B shows two probe (i.e., brush or wiper) designs. These probe designs are provided as examples and are not intended to be limiting. A bifurcated probe (FIG. 4B) or multiple probes (FIG. 4A) provide a transmission path that spans a source or termination gap in, for example, a microstrip transmission line; thereby maintaining a stationary frame and a rotating frame in electrical contact.

FIG. 4A depicts a rotary coupler 400A that includes multiple conductive probes (i.e., brushes or wipers) 402A and 402B, attached to a rotating member 408. Microstrip transmission line 411 is coupled to a stationary member 414 and includes conductors 404 and 406, a dielectric 410 and a ground plane 412. Conductors 404 and 406 are attached to dielectric 410. Dielectric 410 is attached to ground plane 412. Probes 402A and 402B are spaced such that at least one of probes 402A or 402B maintains contact with conductor 404 and/or 406 as rotating member 408 moves in relation to stationary member 414. In this manner, electrical contact is maintained between rotating member 408 and stationary member 414 at a source or termination gap 405.

FIG. 4B depicts a rotary coupler 400B in which a bifurcated conductive probe (i.e., brush or wiper) 402C is attached to a rotating member 408. Bifurcated conductive probe 402C ensures that contact is maintained between bifurcated probe 402C and a conductor 404 and/or 406 (of a microstrip transmission line 411). Microstrip transmission line 411 is coupled to stationary member 414 and includes conductor 404 and 406, a dielectric 410 and a ground plane 412. Conductor 404 and 406 are attached to dielectric 410. Dielectric 410 is attached to ground plane 412. Thus, electrical contact is maintained between rotating member 408 and stationary member 414 at a source or termination gap 405.

Figure 5:
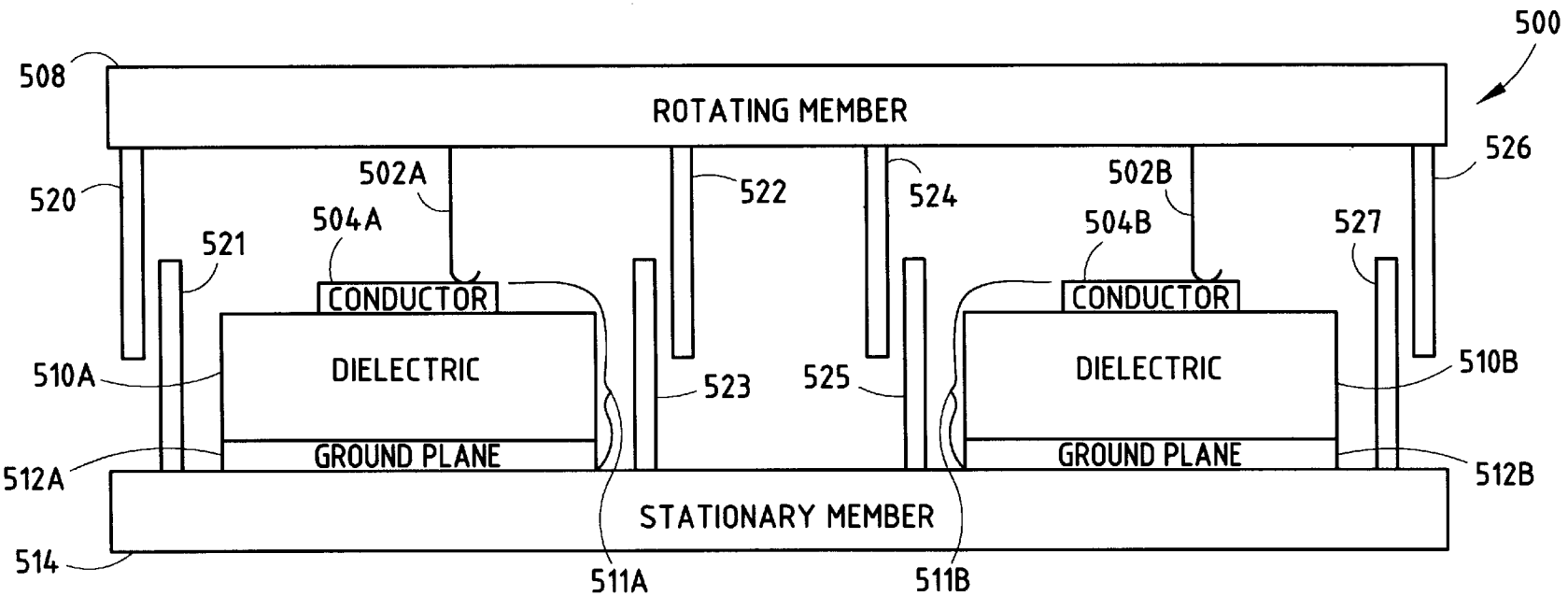
FIG. 5 is a cross-sectional view of a shielded version of a rotary coupler, according to an embodiment of the present invention.

FIG. 5 is a cross sectional view of a pair of conductive transmission lines (fashioned as rings) and a pair of conductive probes that are placed within shields on both the stationary frame and a rotating frame, respectively. These shields are designed to prevent electromagnetic interference between signals. One or more rotary couplers can be placed on the same platter or drum, or on other platters or drums within the slip ring assembly. Power to drive the rotary electronics can be provided by power channels on the same platter or drum or on other platters or drums within a slip ring assembly. Multiple data channels can also be incorporated onto the same platter or drum or other platters or drums within the slip ring assembly.

A rotary coupler 500 includes multiple transmission paths. In this embodiment, shields 520, 522, 524 and 526 are attached to a rotating member (frame) 508. Additionally, shields 521, 523, 525 and 527 are attached to a stationary member (frame) 514. Shields 520, 521, 522 and 523 prevent a signal that is coupled through a conductive probe 502A and a conductor 504A from interfering with a signal that is coupled through an adjacent transmission path. Likewise, shields 524, 525, 526 and 527 prevent a signal that is coupled through a conductive probe 502B and a conductor 504B from interfering with a signal that is coupled through an adjacent transmission path.

While transmission line rings are often fabricated on printed circuit boards, it is contemplated that these conductors can be plated, painted, bonded or otherwise attached to a suitable substrate. A rotating conductive probe and a stationary conductive ring (or a rotating conductive ring and a stationary conductive probe) are typically held in relative position to each other by a precision bearing system that allows relative rotary motion, but prevents excessive run-out or misalignment.

As stated above, a signal that is received on the other side of a rotary coupler can be subjected to secondary processing to amplify, "re-clock" (digital), or otherwise condition the signal to prepare it for various receiver configurations. If desired, the signal can be electronically converted. For example, the signal can be converted to an optical signal and injected onto a fiber optic cable for output.

When utilized to transfer digital data, the slip ring system described herein can be used at low bit rates, but will typically be used with digital bit rates above 200 Mbit/sec. Potential applications include Gigabit Ethernet, Fibre Channel, ATM (at 622 Mb/sec and 2.5 Gbit/sec), and other standard communications rates, nonstandard rates or variable data rates. The conductive slip ring system described herein can also be used with analog signals from DC to multi-gigahertz frequencies. Potential applications include radio, telephony, radar and other high frequency communications.

In conclusion, the delta configuration of resistors matches and attenuates reflections from the brush. The gap in the transmission line at the source allows a resistor to connect the two portions, which along with two other resistors (in a delta configuration) provides a matching impedance for the signal reflected from the brush. Thus, the impact of reflections on source impedance is minimized since the reflections into the source are attenuated.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A conductive slip ring system for transferring information electrically between a moving frame and a stationary frame, comprising:

a conductive transmission line attached to the stationary frame or the moving frame, the conductive transmission line providing for electrical contact over substantially all of one of its surfaces, the conductive transmission line including:

a first portion having a first end and a second end, wherein the first end of the first portion is coupled to a first terminator and the second end of the first portion is coupled to a signal source through a first reflection path impedance matching resistor; and a second portion having a first end and a second end, wherein the first end of the second portion is coupled to a second terminator and the second end of the second portion is coupled to the signal source through a second reflection path impedance matching resistor, and wherein the second end of the first portion and the second end of the second portion are coupled together by a third reflection path impedance matching resistor; and a conductive probe attached to another transmission line on the moving frame or the stationary frame, the conductive probe contacting the conductive transmission line and providing a communication path between the stationary frame and the moving frame, wherein the conductive probe and the conductive transmission line are on opposing frames.

2. The conductive slip ring system of claim 1, wherein the moving frame moves rotationally with respect to the stationary frame.

3. The conductive slip ring system of claim 1, wherein the moving frame moves curvilinearly with respect to the stationary frame.

4. The conductive slip ring system of claim 1, wherein the conductive probe is a wiper.

5. The conductive slip ring system of claim 1, wherein the conductive probe is a brush.

6. The conductive slip ring system of claim 5, wherein the brush is bifurcated.

7. The conductive slip ring system of claim 1, wherein the conductive probe includes a plurality of brushes located such that at least one of the brushes is always in contact with the conductive transmission line.

8. A conductive slip ring system for transferring information electrically between a moving frame and a stationary frame, comprising:

a conductive transmission line attached to one of the stationary frame and the moving frame, the conductive transmission line providing for electrical contact over substantially all of one of its surfaces, the conductive transmission line including:

a first portion having a first end and a second end, wherein the first end of the first portion is coupled to a first terminator and the second end of the first portion is coupled to a signal source through a first reflection path matching impedance; and a second portion having a first end and a second end, wherein the first end of the second portion is coupled to a second terminator and the second end of the second portion is coupled to the signal source through a second reflection path matching impedance, and wherein the second end of the first portion and the second end of the second portion are coupled together by a third reflection path matching impedance; and a conductive probe attached to another transmission line on one of the moving frame and the stationary frame, the conductive probe contacting the conductive transmission line and providing a communication path between the stationary frame and the moving frame, wherein the conductive probe and the conductive transmission line are on opposite ones of the stationary and moving frames.

9. The conductive slip ring system of claim 8, wherein the moving frame moves rotationally with respect to the stationary frame.

10. The conductive slip ring system of claim 8, wherein the moving frame moves curvilinearly with respect to the stationary frame.

11. The conductive slip ring system of claim 8, wherein the conductive probe is a wiper.

12. The conductive slip ring system of claim 8, wherein the conductive probe is a brush.

13. The conductive slip ring system of claim 12, wherein the brush is bifurcated.

14. The conductive slip ring system of claim 8, wherein the conductive probe includes a plurality of brushes located such that at least one of the brushes is always in contact with the conductive transmission line.

15. The conductive slip ring system of claim 8, wherein the first, second and third reflection path matching impedances are resistors.

16. A method for transferring information electrically between a moving frame and a stationary frame, comprising the steps of:

providing a conductive transmission line attached to one of the stationary frame and the moving frame, the conductive transmission line providing for electrical contact over substantially all of one of its surfaces, the conductive transmission line including:

a first portion having a first end and a second end, wherein the first end of the first portion is coupled to a first terminator and the second end of the first portion is coupled to a signal source through a first reflection path matching impedance; and a second portion having a first end and a second end, wherein the first end of the second portion is coupled to a second terminator and the second end of the second portion is coupled to the signal source through a second reflection path matching impedance, and wherein the second end of the first portion and the second end of the second portion are coupled together by a third reflection path matching impedance; and providing a conductive probe attached to another transmission line on one of the moving frame and the stationary frame, the conductive probe contacting the conductive transmission line and providing a communication path between the stationary frame and the moving frame, wherein the conductive probe and the conductive transmission line are on opposite ones of the stationary and moving frames.

17. The method of claim 16, wherein the moving frame moves rotationally with respect to the stationary frame.

18. The method of claim 16, wherein the moving frame moves curvilinearly with respect to the stationary frame.

19. The method of claim 16, wherein the conductive probe is a wiper.

20. The method of claim 16, wherein the conductive probe is a brush.

21. The method of claim 20, wherein the brush is bifurcated.

22. The method of claim 16, wherein the conductive probe includes a plurality of brushes located such that at least one of the brushes is always in contact with the conductive transmission line.

23. The method of claim 16, wherein the first, second and third reflection path matching impedances are resistors.

* * * * *